United States Patent [19]

Segerstad

[11] 4,237,632

[45] Dec. 9, 1980

[54] FRAME ELEMENTS FOR RELEASABLY MOUNTING A POSTER

[76] Inventor: Peder A. G. B. H. A. Segerstad, Sollentunavägen 25, S-191 40 Sollentuna, Sweden

[21] Appl. No.: 969,320

[22] Filed: Dec. 14, 1978

[30] Foreign Application Priority Data

Dec. 20, 1977 [SE] Sweden ..... 7714492

[51] Int. Cl.[3] ..... A47G 1/06

[52] U.S. Cl. ..... 40/156

[58] Field of Search ..... 40/156, 13, 152

[56] References Cited

U.S. PATENT DOCUMENTS

| | | | |
|---|---|---|---|
| 2,979,842 | 4/1961 | De Ridder | 40/156 |
| 3,310,901 | 3/1967 | Sarkisian | 40/156 |
| 3,885,335 | 5/1975 | Egermayer | 40/156 |

FOREIGN PATENT DOCUMENTS

| | | | |
|---|---|---|---|
| 2342534 | 2/1976 | France | 40/156 |

*Primary Examiner*—Gene Mancene
*Assistant Examiner*—Wenceslao J. Contreras
*Attorney, Agent, or Firm*—Frishauf, Holtz, Goodman & Woodward

[57] ABSTRACT

A frame element, for use in fabricating frames for supporting a poster, or the like, comprises an elongated main member and at least one elongated flap member, all of substantially equal length. The main member and the flap member are provided with mutually engageable hinge elements by means of which the flap member is rotatably connected to the main member, the rotational axis of which is parallel with the longitudinal axis of the main and flap members. The main member and the flap member are also respectively provided with cooperating projections and recesses which mutually form a locking device for locking the flap member relative to the main member, the locking device having a definite snap latch position which is passed by when the flap member is hingedly folded toward the poster or the like while inserting the projections into the recesses. The flap member has a longitudinal clamping edge for contacting the poster or the like mounted in the frame and the main member is provided with a longitudinal slot or edge for fixedly receiving the supporting plate or the like. Several of the above frame elements are connected together to form a frame.

15 Claims, 2 Drawing Figures

FRAME ELEMENTS FOR RELEASABLY MOUNTING A POSTER

BACKGROUND OF THE INVENTION

The invention is directed to a frame element for use in a frame mounting of a poster or display sheet in contact with a supporting plate for the poster or, alternatively, for mounting of an inherently stiff poster or the like. The invention is also directed to a frame comprising the frame element.

Frames of different shapes for mounting of posters are previously known. One prior art frame is provided with spring-loaded clamps for clamping the poster against a backing plate. The springs comprised therein are so dimensioned that a clamping force is obtained which is sufficient for holding the poster in position, which creates problems when the clamps should be removed from the poster against the spring force for an eventual secondary adjustment of the position of the poster or removal of the same. Another known frame uses magnetic force for attaching the poster, in which brackets being foldable towards the poster and being made of magnetic material, are arranged to be attracted by a magnetic tape provided on a rear supporting plate along the edge of the poster. The most obvious drawbacks of this frame are that the magnetic tape used will wear out and must be changed after some time of use and that it may involve some problems to obtain a sufficient clamping force, e.g. as a consequence of the character the poster material, from which follows that the range of use of this frame is relatively limited. One further known frame comprises two essentially equivalent frame parts which at one end thereof are interconnected by hinges. During mounting, the poster is positioned between said frame parts which thereafter are pressed against each other and locked. In order to obtain a reasonably uniform distribution of the clamping force along the edge of the poster, said frame parts will have to be dimensioned for a given rigidness, which together with the "double" framework makes a frame of this type comparatively ungainly and unhandy.

The object of this invention is to provide a frame element for the assembly of a frame in which the drawbacks and shortcomings mentioned above are eliminated. One further object of this invention is to provide a frame element having an improved attachment of the poster and a simplified method of mounting. A still further object of this invention is to provide a frame element which is so constructed that it may be manufactured at low cost by an uncomplicated manufacturing method.

SUMMARY OF THE INVENTION

The objects of invention are obtained by means of a frame element which according to the invention comprises an elongated main frame member and at least one elongated clamp member, each of substantially equal lengths. The main frame member and the clamp member are provided with mutually engageable elements of a hinge device by means of which the flap member is rotatably connected to the main frame member and the rotational axis of which is parallel with the longitudinal axis of the members. The main frame member and the clamp member are also provided with cooperating projections and recesses providing for mutually insertable elements of a locking device for relative locking of the clamp member to the main frame member, said projection and/or recesses having elastic flexibility, whereby said locking device will obtain a definite snap latch position which is passed by when the clamp member, by means of said hinge device, is pivoted toward the poster while inserting the projections into the recesses. The clamp member is provided with a longitudinal clamping edge for contacting the poster, and the main frame member is provided with a longitudinal slot or edge for fixedly fixing receiving said supporting plate or the like.

By the features mentioned above and other features which are evident from the claims, the frame element according to the invention has also been given a design making possible a functional use of the character of preferable plastic materials.

The structure of a frame according to the invention comprising the above-described frame elements longitudinally connected together with an outer border member of equal length allows for a great freedom of choice with regard to design and color of the frame.

DETAILED DESCRIPTION

Figure 1:
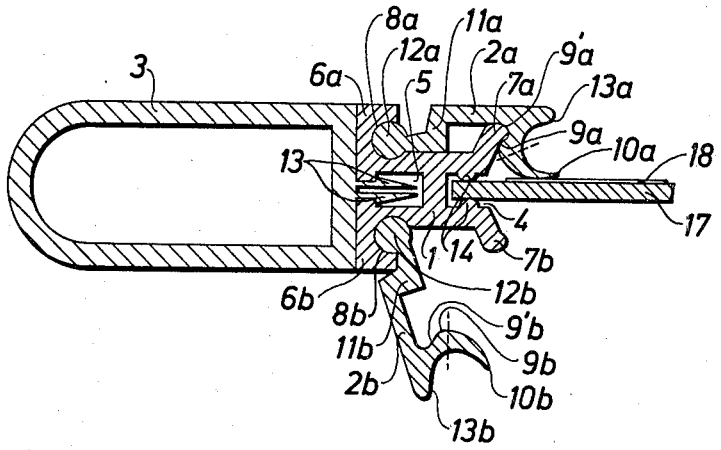
FIG. 1 shows a sectional view of a frame comprising a preferred embodiment of the frame element according to the invention and having a supporting plate on one side of which a poster is mounted.

The frame disclosed in FIG. 1 is intended for mounting of posters on both sides of a supporting or backing plate 17. The frame comprises an elongated main member 1, two elongated clamp members *2a*, and an elongated outer border member 3.

The main frame member 1 in this embodiment comprises an extruded plastic member having a profile shaped substantially as an H in the section transverse to the so-called extrusion line and is therefore designated as an H-profile in the following description. The legs of said H-profile form in one direction a slot 4 in which the supporting or backing plate 17 is fixed by insertion. The ends of said legs forming the slot 4 end in obliquely outwardly extending flanges *7a,7b*. The outermost limiting surfaces of the flanges *7a,7b* are, as shown in FIG. 1, shaped with rounded off projections in order to make possible a locking function to be described below. In the other ends thereof said legs terminate in rectangularly projecting parts *6a, 6b* which form part of a hinge device, and each of which comprises a hinge element shaped as a substantially cylindrical notch *8a* and *8b*, respectively. Said other ends of the H-profile also form boundary or border notch 5 for the attachment of the outer border member 3 to the H-profile. As evident from the drawing, the side walls of notch 4 are provided with projecting studs 14 allowing for the fixation of supporting plates 17 of different thicknesses on one hand by insertion as disclosed on the drawing, and on the other hand by inserting a thicker supporting plate up to studs 14. This makes possible an adaption of the thickness of the supporting plate to the thickness of the poster in order to maintain optimal attachment of the poster.

The outer border member comprises a hollow profile 3, which also is manufactured from an extruded plastic material. The limiting surface of said hollow profile, which is directed towards said H-profile 1, has the same width as the H-profile and is provided with two rectangularly shaped protruding snap-latch elements 13. Each snap-latch element 13 comprises a sliding surface which is inclined in relation to the insertion direction into said border notch 5 and also a transverse locking shoulder. When mounting the border profile 3 on said H-profile 1, the snap-latch elements 13 are inserted into the border notch 5, said sliding surfaces sliding over the notch edges and causing the elements 13 to be bent towards each other, while the locking elements 13 thereafter return to their original shape in this manner, the locking shoulders are brought into engagement with corresponding locking shoulders of said border notch 5 when said hollow profile 3 is brought into engagement with the H-profile 1. By this locking function a good fit of the H-profile against the outer border member 3 along its full length is secured. If both border member and main frame member are manufactured from a material which is fully stable in dimension, said snap-latch elements may be replaced by e.g. a longitudinal projection of a shape which is adapted to the border notch. However, the snap-latch function disclosed on the drawing is of great advantage when putting the frame together.

The clamp members 2*a*, 2*b* are likewise made from an extruded plastic profile which in the section disclosed has essentially the shape of a L. The "foot" or lowermost part of this L-profile is longitudinally folded—as disclosed by the drawing—so that the upper side thereof 9'*a*, 9'*b* forms a locking notch having a locking edge 9*a*, 9*b* and shaped for cooperation with flanges 7*a*, 7*b*. The outermost end of the foot of said L-profile forms the clamping edge 10*a* and 10*b*, respectively, of the clamp members. The upper part of the L-profile is extended by angularly bent parts 11*a* and 11*b*, respectively, having remote ends 12*a* and 12*b*, respectively, being essentially circular in the section disclosed on the drawing. This circular shape indicates a hinge element being essentially cylindrical in the longitudinal direction of the clamp member and having dimensions which are adapted to notches 8*a*, 8*b* so that elements 12*a*, 12*b* may be inserted longitudinally into notches 8*a*, 8*b*.

The angular parts 11*a*, 11*b* of said L-profiles and parts 6*a*, 6*b* of the H-profile of this embodiment are so dimensioned according to the drawing that each clamp member may be pivoted to a position (see clamp member 2*b*) in which the clamping edge 10*a*, 10*b* of the clamp member has passed by a line of sight normal to the supporting plate 17 and tangent to the flanges 7*a* and 7*b*, respectively, of the H-profile, whereby access to the supporting plate when mounting the poster 18 is not hindered by the clamp member. It is to be noted that the possibility of pivoting the clamp members further away than said line of sight is not absolutely necessary for the most frequent use of the frame elements according to the invention, that is as comprised in a frame for mounting of posters being not inherently stiff.

The clamp members 2*a*, 2*b* disclosed in FIG. 1 are provided with a clamping edge 10*a* and 10*b*, respectively, preferably consisting of a plastic material of a type which is softer than the remaining part of the profile. The transition between softer and harder plastic material is indicated by a dotted line. A profile of this type may be manufactured by a so-called co-extrusion operation in which the two relevant materials are extruded simultaneously in and from a single nozzle. The softer clamping edge allows for an adaption to eventual irregularities of poster and supporting plate or the equivalent, and brings with it thereby an improved fit against and attachment of the poster. Thereby the risk of damaging the poster is also eliminated.

The lower side of the lowermost part or foot of the L-profile is designed as a cup shaped gripping edge 13*a*, 13*b*, which may adequately be so dimensioned that the clamp member may be gripped around by the fingertips and pivoted outwards against the locking force acting between locking edges 9*a*, 9*b* and flanges 7*a*, 7*b* of the locking device. In a preferred embodiment of the invention said gripping edge is shaped specifically so that it may be used also for hanging of the frame on adequate screws or nails when the frame is mounted on a wall.

FIG. 1 shows that the locking device has the character of a snap-latch, but the locking position is not obtained momentarily along the full length of the members but instead successively when forcing the locking edges 9*a* and 9*b*, respectively, over the corresponding flanges 7*a* and 7*b*, respectively. This operation of the locking device together with the soft locking edge may be used advantageously when mounting the poster by pivoting the clamp list first to an intermediate position in which the clamp member not completely, and eventually along a part of its full length only, is slidingly engaged over said flanges. In this position a given lower clamping force is exerted between the clamping edge and the poster, which force may be sufficient for holding temporarily the poster and thereby the position of the poster in the frame may be simply adjusted. After this adjustment of position, locking of the flap list is completed in order for the poster to be finally fixed.

From the description given above is evident that either the clamp members or the main frame member or both may be manufactured from a material having such an elasticity that the profiles manufactured therefrom will have a flexibility sufficient for attaining the locking function disclosed. The object of said outer border member 3 is to provide for a stiffening of the frame and to give the same a desirable appearance border member 3 is therefore manufactured from a plastic material of adequate hardness. In one embodiment of the frame, the main frame member and the outer border member are manufactured from the same plastic material.

Figure 2:
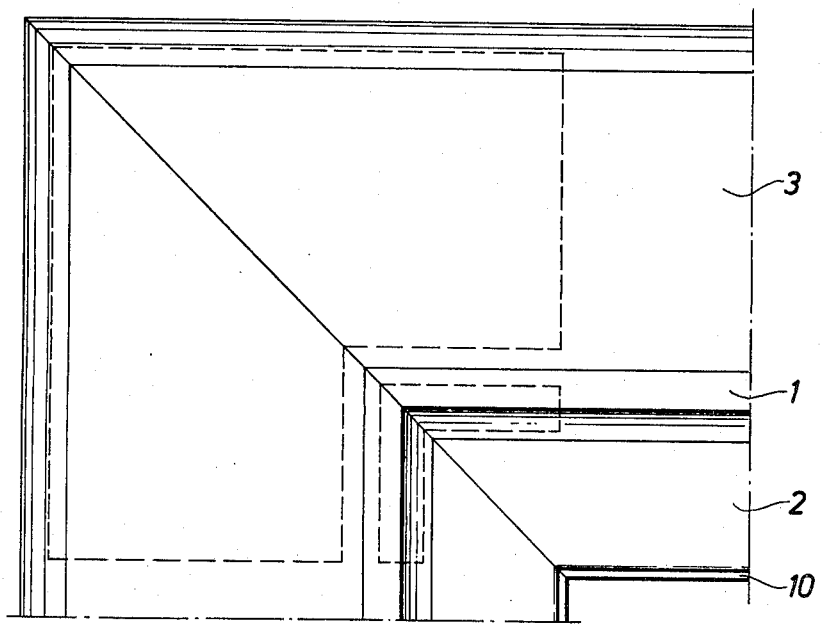
FIG. 2 shows a corner segment of the frame illustrated in FIG. 1.

FIG. 2 discloses a corner segment of the frame disclosed in FIG. 1 from which it is evident that the outer border member 3, the main list 1 and the clamp flap members 2*a*, 2*b* having the clamping edge 10, all have been mitre-cut with the mitre angle 45° and thereafter combined to form a 90° corner. Preferably, the main member 1 and the clamp flap members 2*a*, 2*b* are mitre-cut simultaneously with the clamp members inserted into the main member as shown in FIG. 1, while the outer border member 3 is mitre-cut separately. At the corners the members may adequately be joined by welding of the cutting areas of the outer border members. Alternatively, joining may be obtained by glueing by means of an angular element having legs of a shape which is adapted to the holes of the hollow profile forming the outer border members. The frame element disclosed in the drawing may be used also for a frame without using an outer border member; the corners may then be joined by glueing by means of an angular element having legs of a shape which is adapted to the border notches 5. Both of said angular elements are indicated by dotted lines in FIG. 2.

It is to be noted that FIG. 1 discloses one preferred embodiment of the invention. Accordingly, a simplified embodiment is possible for single side mounting of posters, in which e.g. part 6*b* and flange 7*b* of the H-profile have been eliminated and thereby also the clamp member 2*b*. In such an embodiment the border notch 5 may eventually be eliminated and a corresponding part of the main profile be so shaped that the outer border member 3 may be dispensed with. In a further modified embodiment, the frame element according to the invention may be used for mounting of posters on so called light boxes in which the supporting plate comprises a light transparent or a so called opalized material, for example glass or plastic. In order to simplify the arrangement of the frame element on the light box the border notch may then be replaced by a notch which is rotated 90° relative to the notch 4, and being e.g. directed downwards in FIG. 1 and so dimensioned that the wall of the light box may be inserted into and fixed in said notch.

As is evident from what has been mentioned above, the frame element according to the invention may be used without the outer border member 3. Obviously, this outer border member may be given any desirable shape different from the one disclosed in FIG. 1. The border member 3 as well as the main and clamp members, may be colored arbitrarily when manufactured. Accordingly, it is possible to use a standard color for the main and clamp members and each separate user may obtain his own coloring and eventually also design of the outer border member.

In the embodiment described above all of the members comprised in the frame element, as already mentioned, are manufactured from a plastic material. Obviously, however, e.g. the main frame member may also be manufactured from a metal and for example from an aluminum profile.

Further, it is observed that it is—for obtaining the advantagous locking of the clamp member according the invention—not required that said clamp member is rotatably or otherwise connected to the main frame member. For example, the clamp member may be shaped as a separate clamp member which is attached to the main member by means of the locking device only.

I claim:

1. A frame element for use in assembling a frame for mounting of a poster (18), or the like, comprising:

an elongated main frame member (1) and at least one elongated clamp member (e.g. 2*a*), said clamp member being of substantially the same length as said main frame member;

said main frame member and said at least one clamp member respectively having mutually engageable hinge elements (8*a*, 12*a*) forming a hinge device by means of which said clamp member is rotatably connected to said main frame member with the rotational axis being parallel with the longitudinal axis of said members;

said hinge element of one of said main frame member and clamp member being shaped as a longitudinally extending notch (8*a*) having a longitudinally extending opening communicating with the interior of said notch along the length of said notch, said notch and longitudinal opening extending parallel to the longitudinal axis of said one member and said opening being of a width which is smaller than the diameter of the interior of said notch;

said hinge element of the other of said main frame member and clamp member being formed by an edge of said other member, the outermost part of said edge of said other member being in the form of a longitudinal part (12*a*) extending longitudinally of said other member, said longitudinal part (12*a*) having a width in a direction transverse to the longitudinal direction thereof which is greater than that of said notch and being received into said notch in its lengthwise direction and further being rotatable within said notch, a part of said edge connected to said other member protruding through said longitudinal opening of said notch, said clamp member being thereby rotatable relative to the main frame member around an axis which is parallel to the longitudinal axis thereof and being fixedly connected to the main frame member in a direction transverse to said axis of rotation;

a locking device (7*a*,9′*a*) comprising a longitudinal flange shaped projection (7*a*) integrally formed on one of said main frame member and clamp member, and a longitudinally extending recess (9′*a*) having a locking edge (9*a*) integrally formed on the other of said main frame and clamp members, said projection (7*a*) being engageable with said recess to form a releasable locking device for relative locking of said clamp member to said main frame member, at least one of said projection and said recess having an elastically flexible and yieldable portion whereby the locking device will have a definite snapping latch position which is passed by when said flange shaped projection (7*a*) engages and recess (9′*a*) and said locking edge (9*a*) is resiliently forced over said flange shaped projection (7*a*) during pivoting of said clamp member (2*a*) via the hinge device toward the poster or the like;

said at least one clamp member having an integral longitudinal clamping edge (10*a*) for contacting the poster or the like and pressing against same when said projection and recess of said locking device are mutually engaged; and said main frame member having an integral longitudinal receiving notch or edge (4) for receiving at least one of a supporting member or the like and a poster or the like therein to fixedly mount said poster or the like to said frame element.

2. The frame element of claim 1 wherein said main frame member, on the side thereof which is opposite to said longitudinal receiving notch or edge (4), is provided with a part of a border attachment device, said frame element further comprising an outer border member (3) having another part of a border attachment device which engages the border attachment part of said main frame member to hold said outer border member (3) in contact with said side opposite said receiving notch or edge (4), whereby said frame element is stiffened and kept together.

3. The frame element of claim 2, wherein said outer border member (3) is a stiffening border member, and wherein said attachment device comprises protruding snap latch elements (13) on said stiffening border member (3), said snap latch elements having a transverse locking shoulder; and a border notch (5) on the side of said main frame member (1) opposite to said receiving notch (4), said border notch (5) having corresponding locking shoulders which grippingly engage said shoulders of said snap latch elements when said stiffening border member is brought into contact with said main frame member while inserting said snap latch elements into said border notch.

4. The frame element of claim 1, wherein said longitudinal receiving notch (4) has opposite side walls for fixing said supporting member, said opposite side walls having at least one pair of opposed longitudinal studs (14) or the like providing for a limitation of the width of said notch, whereby supporting members of at least two different thicknesses may alternatively be fixed in said notch by insertion past and up to, respectively, said studs.

5. The frame element of claim 1, wherein said clamping edge (10*a*) of said clamp member (2*a*) comprises a soft and elastical material, whereby an improved contact to and attachment of the poster is obtained.

6. The frame element of claim 1, for use in assembling a frame for double side mounting of posters, or the like, wherein said main frame member (1) is shaped with a substantially H-shaped profile having two pairs of legs, and has two of said flange shaped projections (7*a*, 7*b*) integrally formed thereon, said frame element further comprising two clamp members (2*a*, 2*b*) arranged at the respective opposite sides of said main frame member (1), said longitudinal receiving notch (4) being formed by the space between the uppermost parts of a first pair of said legs of said H-shaped profile, said uppermost parts of said first pair of legs of said H-shaped profile being arranged so as to form also said flange shaped projections (7*a*, 7*b*) and the lowermost parts of the second pair of said legs of said H-shaped profile being arranged to form said longitudinally extending notch (8*a*, 8*b*) of said hinge element.

7. The frame element of claim 1, comprising two clamp members (2*a*, 2*b*) mounted on opposite sides of said main frame member (1), and comprising respective hinge devices for hingedly coupling said clamp members to said main frame member, said main frame member defining a pair of said longitudinal flange shaped projections (7*a*, 7*b*), and said clamp members having respective recesses (9'*a*, 9'*b*) for engaging respective flange shaped projections of said main frame member when the clamp member is pivoted toward said main frame member about said respective hinge device.

8. The frame element of claim 1, wherein said clamp member, near its clamping edge (10*a*), is provided with a gripping edge (13*a*) which also forms a hanging means for use in mounting the frame on a wall, said gripping edge being so dimensioned that said clamp member may be gripped by the finger tips and a detachment force directed away from the poster or the like may be applied thereto.

9. The frame element of claim 1 wherein said flange shaped projection (7*a*) of said locking device comprises a longitudinal flange integrally formed on said main frame member and extending from said main frame member; and said longitudinally extending recess (9'*a*) of said locking device comprises a longitudinal recess integrally formed in said clamp member.

10. The frame element of any one of claims 1 or 9, wherein said longitudinal notch (8*a*) of said hinge device is integrally formed in said main frame member (1) and said longitudinal part (12*a*) which comprises the other of the hinge elements is integrally formed along an edge of said clamp member (2*a*).

11. The frame element of claim 1, wherein said main frame member comprises a plastic extrusion, and said clamp member comprises a plastic extrusion.

12. The frame element of either of claims 1 or 12, wherein said clamping edge (10*a*) of said clamp member comprises a material which is softer than that of the remainder of said clamp member (2*a*).

13. A frame for mounting of a poster (18), or the like, comprising a plurality of frame elements connected together, each of said frame elements including:

an elongated main frame member (1) and at least one elongated clamp member (e.g. 2*a*), said clamp member being of substantially the same length as said main frame member;

said main frame member and said at least one clamp member respectively having mutually engageable hinge elements (8*a*, 12*a*) forming a hinge device by means of which said clamp member is rotatably connected to said main frame member with the rotational axis being parallel with the longitudinal axis of said members;

said hinge element of one of said main frame member and clamp member being shaped as a longitudinally extending notch (8*a*) having a longitudinally extending opening communicating with the interior of said notch along the length of said notch, said notch and longitudinal opening extending parallel to the longitudinal axis of said one member and said opening being of a width which is smaller than the diameter of the interior of said notch;

said hinge element of the other of said main frame member and clamp member being formed by an edge of said other member, the outermost part of said edge of said other member being in the form of a longitudinal part (12*a*) extending longitudinally of said other member, said longitudinal part (12*a*) having a width in a direction transverse to the longitudinal direction thereof which is greater than that of said notch and being received into said notch in its lengthwise direction and further being rotatable within said notch, a part of said edge connected to said other member protruding through said longitudinal opening of said notch, said clamp member being thereby rotatable relative to the main frame around an axis which is parallel to the longitudinal axis thereof and being fixedly connected to the main frame member in a direction transverse to said axis of rotation;

a locking device (7*a*,9'*a*) comprising a longitudinal flange shaped projection (7*a*) integrally formed on one of said main frame member and clamp member, and a longitudinally extending recess (9'*a*) having a locking edge (9*a*) integrally formed on the other of said main frame and clamp members, said projection (7*a*) being engageable with said recess to form a releasable locking device for relative locking of said clamp member to said main frame member, at least one of said projection and said recess having an elastically flexible and yieldable portion whereby the locking device will have a definite snapping latch position which is passed by when said flange shaped projection (7*a*) engages and recess (9'*a*) and said locking edge (9*a*) is resiliently forced over said flange shaped projection (7*a*) during pivoting of said clamp member (2*a*) via the hinge device toward the poster or the like;

said at least one clamp member having an integral longitudinal clamping edge (10*a*) for contacting the poster or the like and pressing against same when said projection and recess of said locking device are mutually engaged;

a stiffening border member(3) connected to a longitudinal side of said main frame member (1) and being of substantially the same length as said main frame member (1); and means for connecting said frame elements together at their respective ends to form a frame.

14. The frame of claim 13, wherein said stiffening border element (3) is a hollow extrusion.

15. The frame of either of claims 13 or 14 comprising attachment means connecting said stiffening border member to said main frame member, said attachment means comprising:

protruding snap latch elements (13) on said stiffening border members, said snap latch elements (13) having a transverse locking shoulder; and a border notch (5) on the side of said main frame member (1) opposite to said receiving notch (4), said border notch (5) having corresponding locking shoulders which grippingly engage said shoulders of said snap latch elements when said stiffening border member is brought into contact with said main frame member while inserting said snap latch elements into said border notch.

* * * * *